United States Patent [19]

Yamazawa

[11] 4,352,333

[45] Oct. 5, 1982

[54] SEWING MACHINE HAVING THREAD CUTTING DEVICE

[75] Inventor: Masayuki Yamazawa, Kariya, Japan

[73] Assignee: Aisin Seiki Kabushiki Kaisha, Kariya, Japan

[21] Appl. No.: 169,692

[22] Filed: Jul. 17, 1980

[30] Foreign Application Priority Data

Jul. 17, 1979 [JP] Japan ..... 54-098923[U]

[51] Int. Cl.[3] ..... D05B 65/02

[52] U.S. Cl. ..... 112/291; 112/295; 112/288; 112/274

[58] Field of Search ..... 112/295, 291, 288, 285, 112/274

[56] References Cited

U.S. PATENT DOCUMENTS

| | | | |
|---|---|---|---|
| 1,490,533 | 4/1924 | Kiewicz | 112/291 |
| 1,565,159 | 12/1925 | Kiewicz | 112/295 |
| 2,846,967 | 8/1958 | Doerr et al. | 112/291 |
| 2,914,010 | 11/1959 | Cohen | 112/291 |
| 3,191,562 | 6/1965 | Frankel | 112/291 X |

*Primary Examiner*—H. Hampton Hunter
*Attorney, Agent, or Firm*—Sughrue, Mion, Zinn, Macpeak & Seas

[57] ABSTRACT

A sewing machine is provided with a needle thread cutting device for severing the free end of the needle thread extending through the eye of the needle at the beginning of a sewing operation to prevent entanglement of the free end with the stitches being formed. A cutter element is mounted for oscillating movement in conjunction with the raising and lowering of the presser foot. The lower end of the cutter element is provided with a transverse leg extending across the upper surface of the presser foot in close proximity thereto rearwardly of the needle. The transverse leg portion is provided with a cutting edge on the side thereof remote from the needle. Subsequent to a previous sewing operation the raising and lowering of the presser foot will oscillate the cutter element to move the leg portion from a position behind the needle thread to a position in front of the needle thread so that upon initiation of a new stitching operation the free end of the needle thread will be severed relatively close to the first stitch.

8 Claims, 18 Drawing Figures

FIG. 6
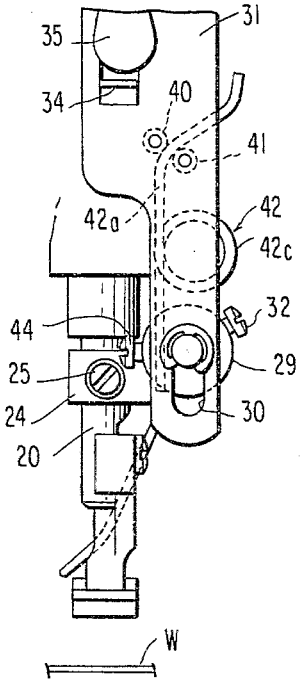
FIG. 7
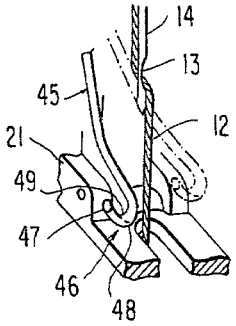
FIG. 8
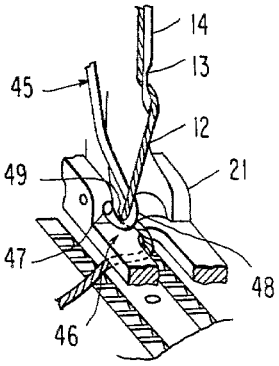
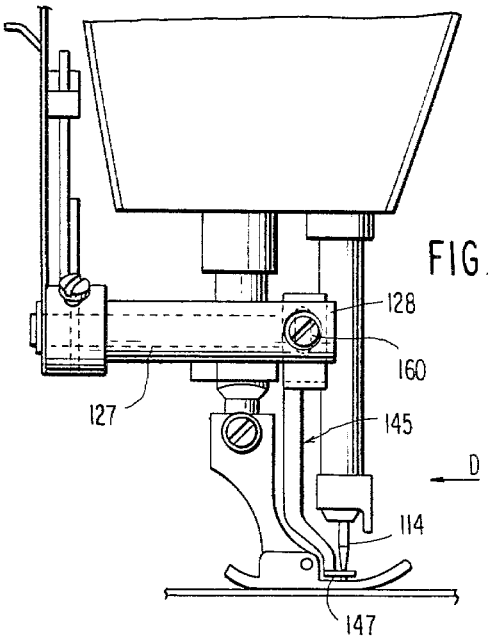
FIG. 9
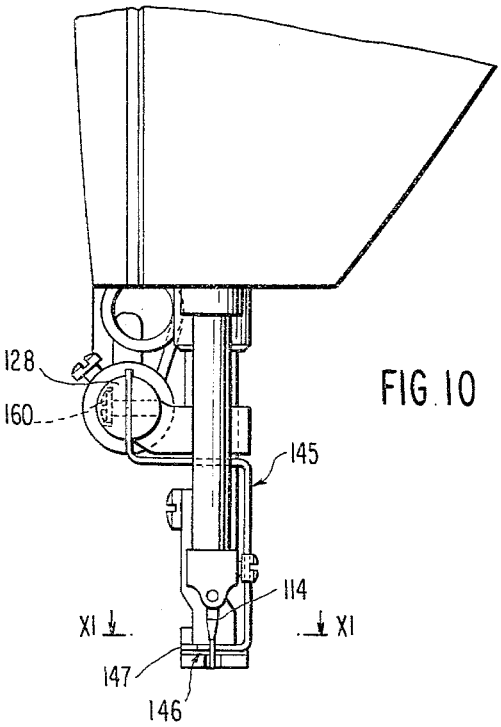
FIG. 10
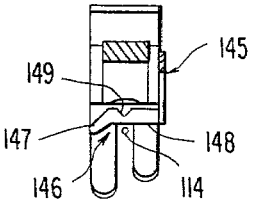
FIG. 11

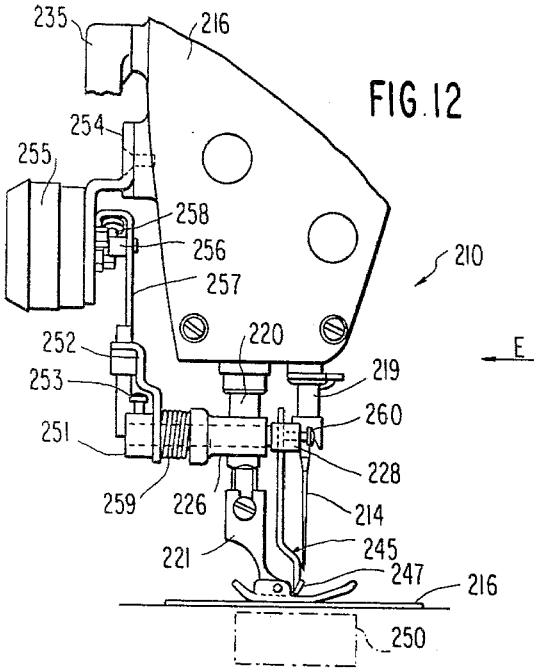
FIG.12
FIG.13
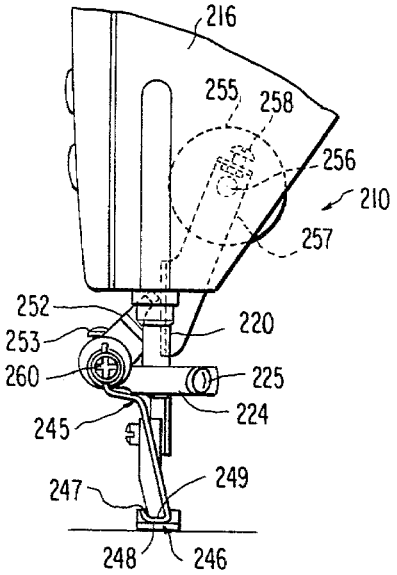
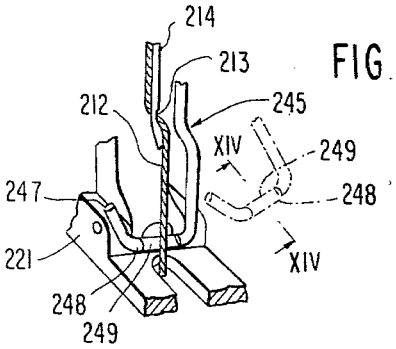
FIG.14
FIG.15
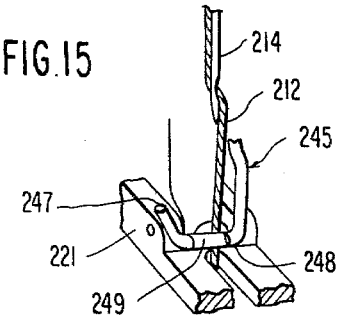
FIG.18
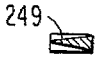
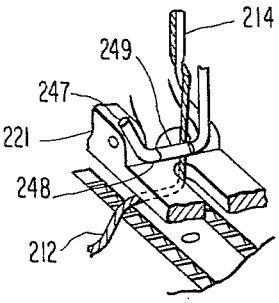
FIG.16
FIG.17
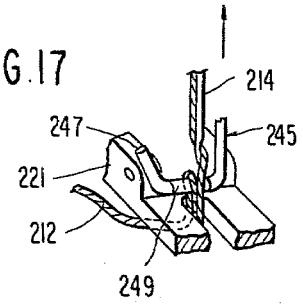

SEWING MACHINE HAVING THREAD CUTTING DEVICE

BACKGROUND OF THE INVENTION

1. Field of the Invention

The present invention relates to a sewing machine having a thread cutting device for severing the free end of the needle thread at the beginning of a sewing operation.

2. Description of the Prior Art

In a conventional sewing machine having a thread cutting device a needle thread and a bobbin thread are severed simultaneously below the throat plate upon completion of a sewing operation. Subsequent to the severing operation the needle and presser foot are both raised to their uppermost positions allowing the workpiece to be withdrawn. The withdrawal of the workpiece will place the free end of the needle thread which extends through the needle eye upon the upper surface of the throat plate.

If the sewing machine is not equipped with a suitable wiper device the free end of the needle thread will be disposed on the upper surface of a subsequent workpiece which is positioned beneath the presser foot and needle and will be held in place thereon during a subsequent sewing operation by means of the presser foot. Thus the free end of the needle thread will be flexibly extended from the upper surface of the workpiece upon completion of a subsequent sewing operation. On the other hand, if the sewing machine is equipped with a wiper device, the free end of the needle thread will be moved aside so as to be offset relative to the presser foot and will be drawn downwardly through the workpiece during the first penetration of the needle in a succeeding sewing operation. The free end of the needle thread below the throat plate is apt to become entangled during the succeeding sewing operation so that the reverse side of the workpiece will be unsightly upon withdrawal of the workpiece after completion of the sewing operation. In order to obviate the foregoing difficulties with the free end of the needle thread it has been necessary to cut off the free end of the needle thread manually so that the workpiece will be neat and attractive.

SUMMARY OF THE INVENTION

It is therefore one of the objects of the present invention to provide a sewing machine having a thread cutting device which will operate automatically to obviate the aforementioned difficulties.

It is another object of the present invention to provide a sewing machine having a thread cutting device for automatically cutting off the free end of the needle thread at the beginning of a subsequent sewing operation.

It is still another object of the present invention to provide a sewing machine having a thread cutting device comprised of a cutter element mounted on the presser bar of the sewing machine and having an offset leg portion extending transversely across the presser foot behind the needle of the sewing machine, cutting means on the side of said offset leg portion remote from said needle and means for oscillating said cutter element upon raising and lowering of said presser bar for shifting the free end of a needle thread extending through the needle eye from a position between said offset leg portion and said needle to a position adjacent said cutting surface.

The foregoing and other objects, features and advantages of the invention will be apparent from the following more particular description of preferred embodiments of the invention as illustrated in the accompanying drawings.

BRIEF DESCRIPTION OF THE DRAWINGS

FIG. 2 is an enlarged front elevation view of the portion in FIG. 1 within the circle A.

FIG. 3 is an enlarged side elevation view of the sewing machine as shown in FIG. 1 taken in the direction of the arrow B.

FIG. 4 is a rear elevation view of a sewing machine shown in FIG. 3 as viewed in the direction of the arrow C.

FIGS. 5 and 6 are rear views similar to FIG. 4 showing the presser foot in raised position when raised by lever 35 and linkage 23, respectively.

FIGS. 7 and 8 are enlarged perspective views of the presser foot and cutter element showing the different positions of the cutter element relative to the presser foot.

FIG. 9 is a partial side elevation view of a second embodiment of the present invention.

FIG. 10 is a partial front elevation view of the sewing machine of FIG. 9 as seen in the direction of the arrow D.

FIG. 11 is a cross-sectional view taken along the line XI—XI of FIG. 10.

FIG. 12 is a partial side elevation view of a sewing machine according to a third embodiment of the present invention.

FIG. 13 is a partial front view of the sewing machine of FIG. 12 as viewed in the direction of the arrow E.

FIGS. 14, 15, 16 and 17 are detailed perspective views of the presser foot and cutter element showing the operation of the sewing machine according to the third embodiment in sequential views.

FIG. 18 is a cross-sectional view taken along the line XIV—XIV of FIG. 14.

DETAILED DESCRIPTION OF THE INVENTION

Figure 1:
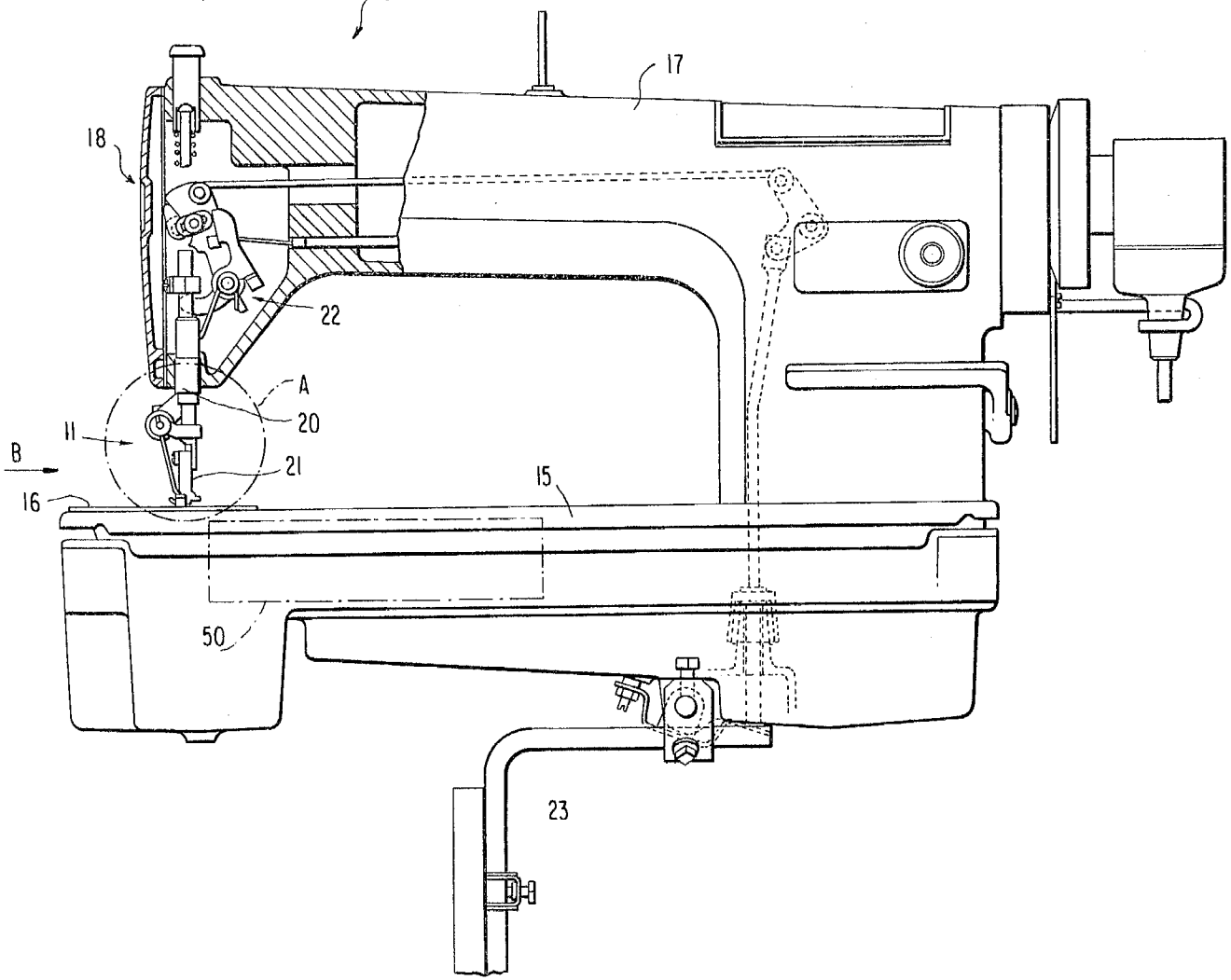
FIG. 1 is a front elevation view, partly in section, of a first embodiment of the present invention.

Referring first to the embodiment of FIGS. 1–8, a sewing machine 10 is shown in FIG. 1 comprised of a bed 15 including a throat plate 16 and an overhanging arm 17 terminating in a head 18 disposed in spaced relation above the bed 15. A presser foot 21 is secured to the lower end of a presser bar 20 which may be raised and lowered by means of the mechanism 22 which is controlled by the knee operated linkage 23. The needle bar, needle and associated operating mechanism have not been illustrated in FIG. 1 for the sake of clarity. The thread cutting device 11 according to the present invention is located within the circle A and is shown in greater detail in FIGS. 2–8.

Figures 2, 3, 4, 5:
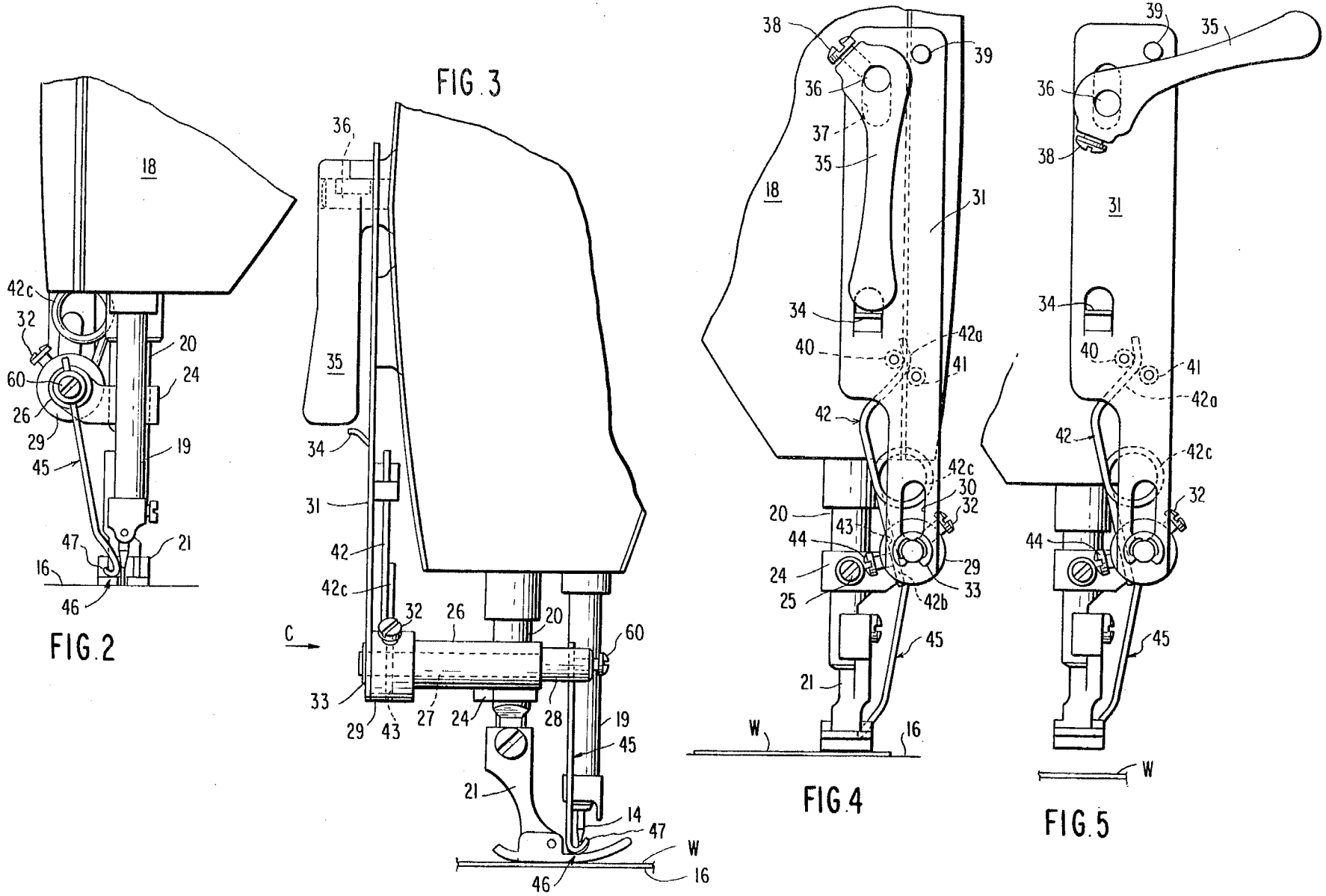

As shown in FIG. 2, a needle bar 19 is mounted for vertical recipricatory movement within the head 18 and a needle 14 having an eye 13 is secured to the lower end thereof. The presser bar 20 is located rearwardly of the needle bar 19 and the needle is operable within the forwardly open slot in the presser foot 21. The presser foot 21 may be raised and lowered by means of a mechanism 22, 23 shown in FIG. 1 or by the lever 35 shown in FIGS. 4 and 5. The details of the arrangement for raising and lowering the presser foot are old and well known in the art and a detailed explanation thereof is not deemed necessary.

With respect to the needle thread cutting device according to the present invention a bracket 24 is secured to the presser bar 20 by means of a screw 25. The bracket 24 supports a tubular sleeve portion 26, the axis of which is parallel to the feed direction of the sewing machine. A shaft 27 is rotatably disposed within the sleeve portion 26 and is provided with an enlarged portion 28 at one end thereof. The enlarged portion 28 of the shaft 27 is disposed in abutment with one end of the sleeve portion 26. The shaft 27 extends through a collar 29 and a lower slot 30 in the guide plate 31 and the shaft 36 upon which lever 35 is mounted extends through an upper slot 37 to movably support plate 31 on the head 18. The collar 29 is secured to the shaft 27 by means of screw 32 and a snap ring 33 is secured in a groove at the other end of the shaft 27 on the opposite side of the guide plate 31 from the collar 29. Thus the shaft 27 is prevented from axial movement within the sleeve 26 while the left hand of the shaft 27 as viewed in FIG. 3 is disposed in sliding engagement with a lower slot 30 of the guide plate 31.

A stop tab 34 is located in the middle portion of the guide plate 31 and is formed by cutting and bending the piece of the guide plate out of the plane thereof. The stop tab 34 is located in closely spaced relationship to the free end of the presser bar control lever 35 when the lever 35 and the guide plate 31 are disposed in the position shown in FIG. 4. A pair of closely spaced pins 40 and 41 are secured to the guide plate below and forwardly of the stop tab 34 and protrude from the guide plate 31 in the opposite direction from the stop tab 34. An actuator member 42 formed of stiff wire is provided for imparting a rotational movement to the shaft 27. One end of the actuator member is slidably disposed between the pins 40 and 41 and is provided with two oppositely directed bends which will act as a cam follower portion. The other end portion **42*b* of the actuator member 42 is secured in a secant hole 43 in the collar 29 by means of a set screw 44. The middle portion 42*c* of the wire actuator member 42** is provided with a single loop to impart a resilient flexibility to the member.

A cutter element 45 of stiff wire has one end thereof secured in an aperture in the enlarged portion 28 of the shaft 27 by means of a set screw 60. The other end of the cutter element 45 is bent to form a hook 46 having an end edge 47 and a curved middle portion formed with a blade for a sharp edge 49 at the rear portion thereof facing toward the presser foot bar. The hooked portion 46 is normally disposed immediately above the presser foot to the rear and to one side of the needle 14 as best seen in FIGS. 2 and 3.

A conventional thread cutting device 50 (FIG. 1) is located below the throat plate 16 to cut the needle thread 12 and a bobbin thread (not shown) simultaneously on completion of a sewing operation. Such cutting devices are old and well known in the art and the construction and operation need not be described in the present application. In the operation of the needle thread cutting device 11 according to the present invention the needle 14 is raised to its uppermost position upon completion of the sewing operation and the subsequent severing of the needle thread and bobbin thread below the throat plate by the cutting device 50. The presser foot 21 is then moved upwardly by actuation of the presser foot lifter linkage 23 prior to the withdrawal of the workpiece W while the presser bar control lever 35 is left in the position shown in FIG. 4. The lifting of the presser bar 20 along with the presser foot 21 causes the shaft 27 to move upwardly in the slot 30 in the guide plate 31 since the guide plate 31 will be maintained in its lowest position by means of the stop tab 34 engaging the free end of the lever 35 as seen in FIG. 6. Since the guide plate 31 is held stationary the pins 40 and 41 will also remain stationary so that upward movement of the shaft 27 and the collar 29 will cause the bent portion **42*a* of the actuator member to move upwardly between the pins 40 and 41. The cam function created by the bends in the member 42 will cause the member 42 to rotate the shaft 27 and thereby swing the thread cutting device 45 from the position shown in FIG. 4 to the position shown in FIG. 6. During this movement of the thread cutting device 45 the needle thread 12 is momentarily displaced in the forward direction by the end edge 47 of the hook portion 46 as the hook portion moves from the solid line position to the phantom position shown in FIG. 7. Thereafter when the workpiece is drawn away from the stitch forming area the free end of the needle thread 12 will be drawn up through the needle hole to rest upon the upper surface of the thread plate 16**.

When a new workpiece is inserted between the throat plate 16 and the presser foot 21 prior to initiating a new sewing operation the free end of the needle thread 12 will then rest upon the upper surface of the new workpiece. Upon lowering of the presser bar 20 the new workpiece and the needle thread 12 will be clamped against the throat plate 16. The downward movement of the presser bar 20 also lowers the member 42 and the thread cutting device 45 will be returned to its original position as shown in FIG. 8 with the needle thread 12 disposed in engagement with the cutting edge 49. As soon as the new sewing operation is commenced the free end of the needle thread will be cut off by the cutting device 49 since the free end of the needle thread 12 is being held by the presser foot 21 while the needle thread is tensioned by the stitch forming operation. Thus the severed end of the needle thread 12 will not become entangled by being drawn below the throat plate 16 during subsequent stitching operations. Also since the needle thread is cut fairly close to the workpiece a long flexible length of needle thread will not protrude from the upper surface of the finished work product.

When it is not necessary or desirable to cut off the free end of the needle thread the presser bar 20 may be lifted by the control lever 35 in lieu of the linkage 23. A pin 39 extends from the guide plate 31 on the same side as the stop tab 34 and is located above and to one side of the upper slot 37 in the guide plate 31. Thus when the control lever 35 is moved from the position shown in FIG. 4 to the position shown in FIG. 5 the lever will engage the pin 39 and since the free end of the lever 35 is no longer disposed adjacent the stop tab 34 the entire guide plate 31 will be raised along with the presser bar 20. Thus the member 42 will not move between the guide pins 40 and 41 to produce any camming action and therefore the thread cutter 45 will not be oscillated.

In the embodiment of FIGS. 9–11, the thread cutter 145 is formed of sheet metal instead of wire and the upper end of the thread cutter is secured in a vertical slot in the end of the enlarged portion 128 of shaft 127 by means of a set screw 160. The lower end portion of the thread cutter 145 is formed into a hooked portion 146 having an end edge 147 and a middle portion 148. The middle portion 148 is disposed at right angles to the feeding direction and is located rearwardly of the needle 114. The end edge 147 is forwardly inclined so as to engage and momentarily displace the needle thread 112 forwardly as the thread cutter 145 moves to the right as viewed in FIG. 11. A V-shaped cutting blade 149 is provided in the rear edge of the middle portion 146 so that upon return of the thread cutter arm 145 the needle thread will be moved rearwardly by the portion 145 into the V-shaped blade portion for subsequent severing upon the initiation of a new stitch forming operation. The oscillation of the thread cutter arm 145 is accomplished in the same manner as discussed in the previous embodiment.

In the embodiment shown in FIGS. 12–18, the sewing machine 210 is provided with a head 216 having a needle bar 219 and a presser bar 220 mounted therein for vertical reciprocation. A needle 214 is secured to the end of the needle bar 219 and a presser foot 221 is pivotally mounted on the end of the presser bar 220. The presser bar 220 may be raised and lowered by means of a hand lever 235 as is well known in the art. The details of the needle bar drive and the connection for raising and lowering the presser bar are not shown since they are also considered to be old and well known in the art.

A bracket 224 is secured by means of a screw 225 to the presser bar 220. The bracket 224 is provided with a tubular sleeve portion 226 the axis of which is disposed parallel to the feeding direction of the fabric beneath the presser foot 221. A shaft 227 having an enlarged end portion 228 is rotatably disposed within the sleeve portion 226. The enlarged portion 228 is disposed in abutment with one end of the sleeve 226. The hub portion 251 of a lever 252 is secured to the opposite end of the shaft 227 by means of a set screw 255 in spaced relation to the sleeve portion 226. A torsion spring 259 is disposed about the shaft 227 and is connected at opposite ends to the hub portion 251 of the lever 252 and the sleeve portion 226 in a manner to normally bias the lever 252 in the clockwise direction as viewed in FIG. 13.

A rotary solenoid 255 is secured to the rear side of the head 216 by means of a bracket 254. The rotary solenoid 255 has an axle 256 which is designed to be rotated clockwise as viewed in FIG. 13 upon energization of the rotary solenoid 255 and which is free to return to its original position upon de-energization of the rotary solenoid 255. One end of a lever 257 is secured to the end of the solenoid axle by means of a set screw 258. The other end portion of the lever 257 is disposed approximately at right angles to the throat plate 216 in engagement with the free end portion of the lever 252. Thus upon energization of the solenoid 255 the clockwise movement of the lever 257 will rotate the shaft 227 in the counter-clockwise direction due to engagement with the lever 252. When the solenoid is de-energized the torsion spring 259 will return the levers 252 and 257 to the positions shown in FIG. 13. One end of the thread cutter 245 extends through an opening in the enlarged shaft portion 228 and is secured therein by means of a set screw 260. The other end portion of the cutter 245 is formed into a hook 246 having an end edge 247 and a middle portion 248 having a blade edge 249 provided on the rear edge thereof. The hook portion 246 of the cutter 245 is located between the presser foot 221 and the needle 214 with the middle portion being disposed at approximately right angles to the direction of feed of the sewing machine. The end edge 247 of the hook portion 246 is so formed that the needle thread 212 depending from the needle eye 213 of the needle 214 may be momentarily displaced forwardly by the edge 247 in the course of movement of the thread cutter to the right as viewed in FIG. 14 and will be caught by the hooked portion 246 during movement to the left as viewed in FIG. 15. In other words, the needle thread 12 is displaced from the front of the hooked portion 246 to the rear of the hooked portion 246 during the oscillatory movement of the thread cutter 245.

As in the previous embodiment a thread cutting device 250 is installed below the throat plate 216 so as to cut the needle thread 212 and a bobbin thread (not shown) simultaneously upon completion of a sewing operation. Thereafter the needle 214 is moved upwardly to its fully raised position and the rotary solenoid 255 is energized to turn. As a result of the energization of the rotary solenoid 255 the lever 257 is rotated clockwise as viewed in FIG. 13 to rotate the lever 252 counter-clockwise against the force of the torsion spring 259. Therefore, the thread cutter 245 will be moved from the solid line position to the phantom line position as shown in FIG. 14. As mentioned above, this movement of the thread cutter device 245 will cause the needle thread 212 to be momentarily displaced in the forward direction by the end edge 247 but the thread 212 will be returned to the original position as soon as the thread cutter device 245 reaches the phantom line position of FIG. 14. Thereafter in the course of the return movement of the thread cutter device 245 to the original position as shown shown in FIG. 15 upon de-energization of the rotary solenoid the thread 212 will be captured by the hook portion 246. After the presser foot 221 is raised by actuation of the lever 235 the workpiece can be withdrawn and the free end of the needle thread will then rest upon the upper surface of the thread plate 216. Thereafter when a new workpiece is inserted between the throat plate 216 and the presser foot 221 the free end of the needle thread 212 will then rest on the new workpiece. Upon lowering of the presser foot 221 the free end of the needle thread and the new workpiece will be held against the throat plate 216 as shown in FIG. 16. Upon starting of the sewing operation the free end of the needle thread 212 will be cut off by the blade 249 since the needle thread 212 will be tensioned between the presser foot 221 and the stitch forming mechanism as shown in FIG. 17. Thus the free end of the needle thread will not be drawn beneath the throat plate during succeeding sewing operations nor will the elongated flexible thread end protrude from the upper surface of the workpiece to spoil the appearance thereof.

Although the cutting blade has been provided on the rear side of the middle portion in each of the embodiments it is also possible to locate the cutting blade on the forward side of the middle portion as long as the thread cutting device is maintained in proper adjustment relative to the needle so that the needle thread will not be cut during a sewing operation.

While the invention has been particularly shown and described with reference to preferred embodiments thereof, it will be understood by those in the art that the foregoing and other changes in form and details may be made therein without departing from the spirit and scope of the invention.

What is claimed is:

1. A sewing machine comprising a bed including a throat plate, an overhanging arm extending from said bed and terminating in a head, a needle bar mounted for reciprocatory movement in said head, a needle carried by said needle bar, a presser bar mounted for vertical reciprocatory movement in said head rearwardly of said needle bar, a presser foot pivotally mounted on said presser bar for holding a workpiece against said throat plate, a presser bar control lever means for moving said presser foot in the vertical direction with said presser bar between a raised position and a lowered position, cutting means for cutting off a needle thread and a bobbin thread simultaneously below said throat plate upon completion of a sewing operation and thereafter locating said needle at its uppermost position and a thread cutting device for cutting off the free end of said needle thread at the beginning of a subsequent sewing operation.

2. A sewing machine as set forth in claim 1 wherein said thread cutting device is comprised of a hollow tubular sleeve, means for securing said sleeve to said presser bar with the axis of said sleeve parallel to the feeding direction of said sewing machine, a shaft rotatably mounted in said sleeve, drive means for rotating said shaft, an elongated cutter element secured at one end thereof to one end of said shaft having hook means with a cutting edge thereon connected to the other end thereof for positioning a needle thread adjacent said cutting edge upon oscillation of said shaft so that upon subsequent initiation of a stitching operation said needle thread will be cut by said cutting edge.

3. A sewing machine as set forth in claim 2 wherein said drive means is comprised of a rotary solenoid adapted to be actuated after said needle is raised to its uppermost position.

4. A sewing machine as set forth in claim 3 wherein said rotary solenoid includes a rotatable axle, a first lever secured to one end of said axle, a second lever secured to the other end of said shaft, said first and second levers being disposed in operative engagement with each other for transmitting rotary movement while permitting vertical movement of said levers relative to each other as said presser bar is raised and lowered.

5. A sewing machine as set forth in claim 4 further comprising a torsion spring connected between one end of said second lever and said sleeve for biasing said second lever in the direction for returing said first lever to the original position thereof upon de-energization of said rotary solenoid.

6. A sewing machine as set forth in claim 2 further comprising foot lifter means for moving said presser foot in the vertical direction between a raised and lowered position independent of said presser bar control lever means, said drive means being in operative engagement with said presser bar control lever means for initiating operation of said drive means upon raising of said presser bar by said presser foot lifting means.

7. A sewing machine as set forth in claim 6 wherein said drive means includes a guide plate having a pair of vertically disposed slots therethrough at the upper and lower ends thereof through which said control lever means and said shaft extend respectively, stop means on said guide plate adapted to engage said control lever means to prevent movement of said guide plate upon raising of said shaft, an elongated shaft actuator member having one end thereof bent to form a cam follower portion, a collar fixedly secured to the other end of said shaft, means for securing the other end of said actuator member to said collar, a pair of closely spaced guide pins secured to said guide plate for camming said cam follower portion of said actuator member therebetween whereby movement of said cam follower portion between said pins will oscillate said shaft upon raising and lowering of said presser bar.

8. A sewing machine as set forth in claim 7 wherein said stop means is comprised of a stop tab extending out of said guide plate and the free end of said control lever means when it is disposed in a vertical downwardly directed position.

* * * * *